US006848808B2

(12) United States Patent
Guerrieri

(10) Patent No.: US 6,848,808 B2
(45) Date of Patent: Feb. 1, 2005

(54) COMBINATION FASTENER AND LIGHTING DEVICE

(75) Inventor: Salvatore Guerrieri, New York, NY (US)

(73) Assignee: Acolyte Technologies, LLC, New York, NY (US)

( * ) Notice: Subject to any disclaimer, the term of this patent is extended or adjusted under 35 U.S.C. 154(b) by 0 days.

(21) Appl. No.: 10/382,219

(22) Filed: Mar. 5, 2003

(65) Prior Publication Data

US 2004/0174702 A1 Sep. 9, 2004

(51) Int. Cl.[7] ..... A45C 15/06

(52) U.S. Cl. ..... 362/156; 362/155; 362/394; 362/396

(58) Field of Search ..... 362/155–156, 362/555, 800, 286, 194–195, 394, 396, 398

(56) References Cited

U.S. PATENT DOCUMENTS 6,267,485 B1 * 7/2001 Rodgers ..... 362/156

6,582,093 B1 * 6/2003 Branaugh et al. ..... 362/156

* cited by examiner

*Primary Examiner*—Alan Cariaso
*Assistant Examiner*—Guiyoung Lee
(74) *Attorney, Agent, or Firm*—Abelman, Frayne & Schwab

(57) ABSTRACT

A combination fastener and separate, manually operable lighting device includes a pair of complimentary fastener members for releasably securing portions of a portable carrying case, such as a lady's handbag, in a closed position when mating surfaces of the complementary members are placed in contact with each other. The lighting device includes a light emitting diode (LED), battery and switch, and an optional programmed microprocessor controller, that is removably secured to a first member of the pair of fastener members. The lighting device is deactivated when the mating surfaces are placed proximate to each other and is activated to illuminate an interior of the accessory when the surfaces are separated. The lighting device utilizes a reed switch which responds to a proximate magnetic force and the complimentary member includes a magnet so that the powers to the LED is turned off when the mating surfaces are brought into contact with each other.

12 Claims, 5 Drawing Sheets

COMBINATION FASTENER AND LIGHTING DEVICE

FIELD OF THE INVENTION

This invention relates to fasteners for accessories, and in particular to a combination fastener and lighting device for use with handbags, carrying cases and other similar accessories.

BACKGROUND OF THE INVENTION

Known fasteners for handbags, purses, and like accessories, generally and inclusively referred to hereafter as "carrying cases", are secured by bringing together complementary portions of the fastener for a friction fit and/or for magnetic engagement. Typically, such known fasteners serve only to join together separate portions of the carrying case such as a fold-over flap of a lady's handbag.

As used herein the term "fastener" means two-part closures that securely, but releasably join the opposing surfaces of a container, whether by mechanical engagement of mating elements forming a portion of the opposing members, or by attractive magnetic forces.

Lighting devices are also known for illuminating the interiors of carrying cases. Typically, such lighting devices are bulky, requiring a separate battery and battery holder, and associated wiring to be secured in the accessory. Although the lighting devices can be activated by the opening and closing of opposing or mating portions of the case, such lighting devices are separate and distinct from the fasteners.

It is therefore one object of the present invention to provide, in combination, a fastener and lighting device to illuminate the interior of a carrying case when the complementary members of the fastener are separated to open the case.

It is a further object of the invention to provide an improved magnetic fastener that is adapted to securely retain a removable light source that is actuated when the fastener is opened and closed, such actuation being by either magnetic or mechanical forces.

BRIEF SUMMARY OF THE INVENTION

These objects and other advantages are achieved by a combination fastener and lighting device that includes a pair of complementary fastener members for releasably securing portions of a carrying case in a closed position. The lighting device includes a light emitting diode (LED) and/or an incandescent light source, battery and switch, and is incorporated in a first of the pair of fastener members. The lighting device is deactivated when the fastener surfaces are placed in mating relation with each other. The lighting device is activated to illuminate an interior of the carrying case when the mating fastener surfaces are separated from each other.

One of the complimentary members can be magnetic, and the lighting device can include a reed switch that is normally open and which responds to a magnetic force to deactivate the LED or other light source when the complementary surfaces are brought proximate to each other.

For convenience, references to LEDs in connection with the description of the invention are to be understood as also including one or more incandescent bulbs as the light source.

In alternative embodiments, the fastener can be a pair of snap fasteners, bayonet fasteners, or any other type of mechanical fastener where a first member comes in close proximity to, or in contact with the second member.

In a further embodiment, the lighting device is removably secured to one of the fastener members so that it can be used as a hand-held light, manually-activated source independent of the carrying case, or simply to facilitate replacement of depleted batteries.

BRIEF DESCRIPTION OF THE DRAWINGS

Preferred embodiments of the invention are described below and with reference to the appended drawings, wherein.

DETAILED DESCRIPTION OF THE PREFERRED EMBODIMENTS

Figure 1A:
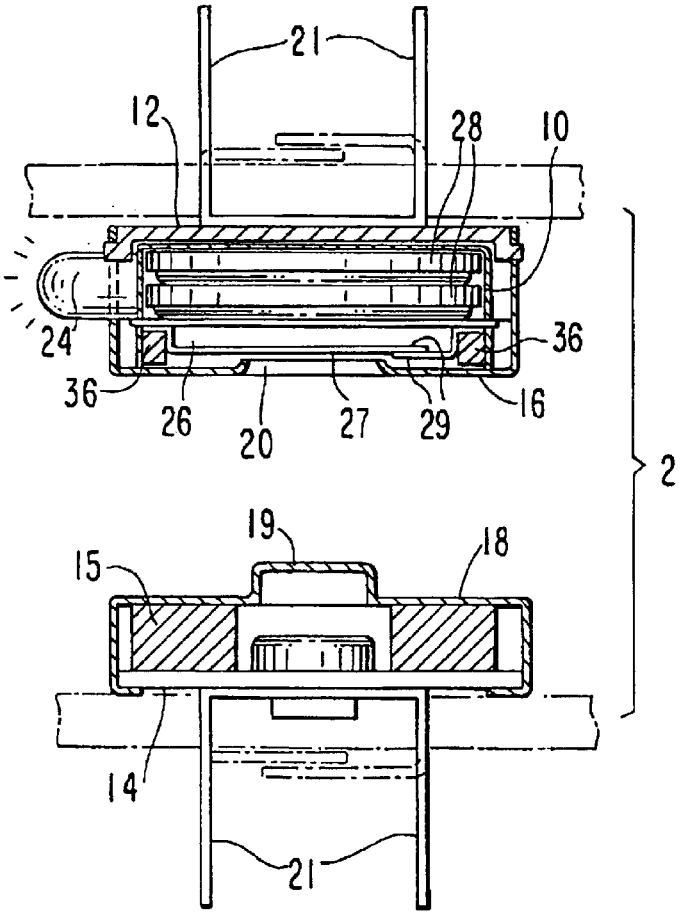
FIG. 1A is a side elevation view, partly in cross-section, of one embodiment of a combination magnetic fastener and lighting device in accordance with the present invention with the fastener on the open or separated position.
Figure 1B:
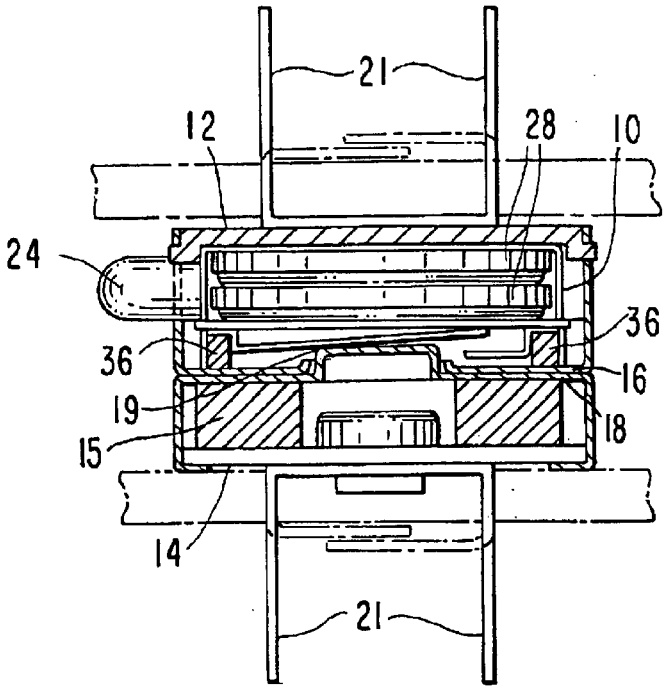
FIG. 1B is a view of the embodiment of FIG. 1A with the fastener in the closed position.

As shown in FIG. 1, a combination fastener and lighting device assembly 1 includes a pair of complimentary fastener members 12, 14 of the fastener 2 for removably securing portions of a carrying case in a closed position when complementary mating surfaces 16, 18, respectively, of the complementary fastener members 12, 14 are placed in contact with each other. The fastener members 12, 14 are secured to the portions of the accessory, such as a flap and side wall of a handbag (not shown), using conventional mounting prongs 20.

The lighting device 10 includes a circuit containing at least one light-emitting diode (LED) 24, a switch 26, and at least one battery 28. The switch 26 comprises movable arm element 27 and contacts 29. The lighting device can include the features described in U.S. Pat. No. 6,120,162, and co-pending U.S. application Ser. No. 09/750,879, the disclosures of which are incorporated herein by reference.

The lighting device 10 is incorporated in first member 12 of the pair of complementary fastener member 2. Mating surface 16 is provided with an access aperture 20 above switch 26. Mating surface 18 includes a projecting portion 19 that is receivable in aperture 20, and which contacts and moves switch arm 27 to open contacts 28 when the fastener members 12 and 14 are brought into mating relation.

The lighting device is deactivated so that the LED 24 does not generate light when the complementary surfaces 16, 18 are placed in contact with each other to thereby open the contacts 29 of the switch 26. The lighting device is activated to power the LED 24 to illuminate an interior of a case when the complementary surfaces 16, 18 are separated from each other and the switch contacts 27 close the circuit with the battery power source 28.

In one preferred embodiment, any physical pressure on the surface 16 actuates the switch 26 to deactivate the LED 24. In a further preferred embodiment, switch element 27 includes a microprocessor 36 included in the circuit of lighting device 10 so that switch 26 will function as a push button 'on-off' switch.

Figure 2A:
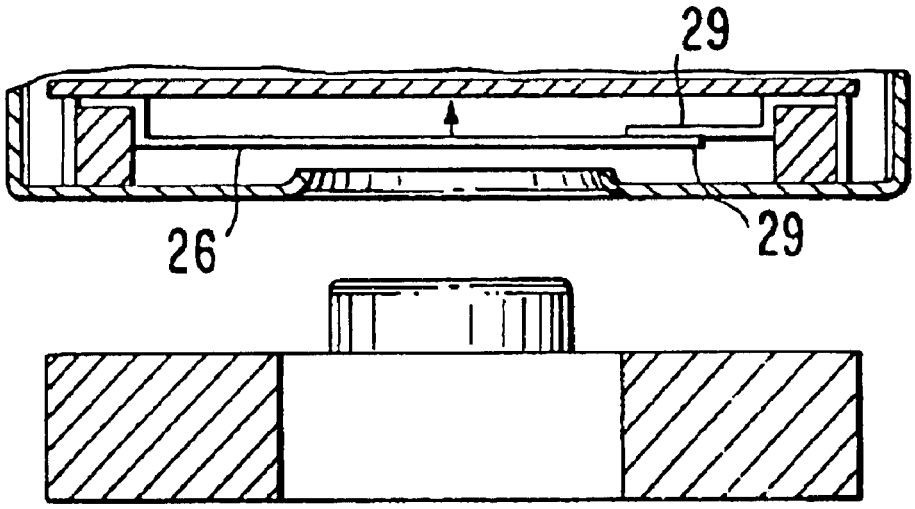
FIG. 2A is a side elevation view, partly in cross-section of another embodiment of the invention with a magnetically activated switch, with the fastener in the open position.
Figure 2B:
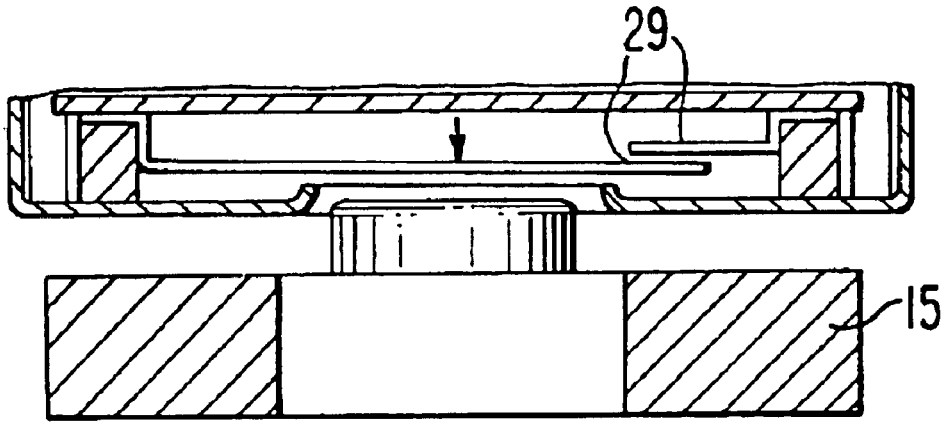
FIG. 2B is a view of the embodiment of FIG. 2A in the closed position.

Alternatively, the switch 26 of the lighting device 10 responds to a magnetic force and/or manually-applied force to activate and deactivate the switch controlling the LED 24. In this preferred embodiment, shown in FIGS. 2A and 2B, the complimentary members includes a magnet 15 and the housing or cover of the second member 12 is made from a ferromagnetic material, the fastener members being attracted and secured together by magnetic force. In this embodiment, switch 26 can be a reed switch that responds to magnetic force from magnet 15 in the second member 14 to cause the moveable element of the switch to move away from contact 28 and thereby open the circuit. Thus, when the complementary surfaces 16, 18 are separated from each other, the switch 26 moves to close contacts 28 and the LED 24 is turned on. In this embodiment, the projecting portion 19 serves to align the mated elements 12 and 14.

Accordingly, the lighting device can have a compact configuration to be incorporated into one of the pair of fastener elements used with a container or carrying case, such as a handbag, to illuminate its interior when the fastener elements are separated from each other. Mounting elements 57 permit attachment to the opposing surfaces of the container that are to be closed.

Figure 3A:
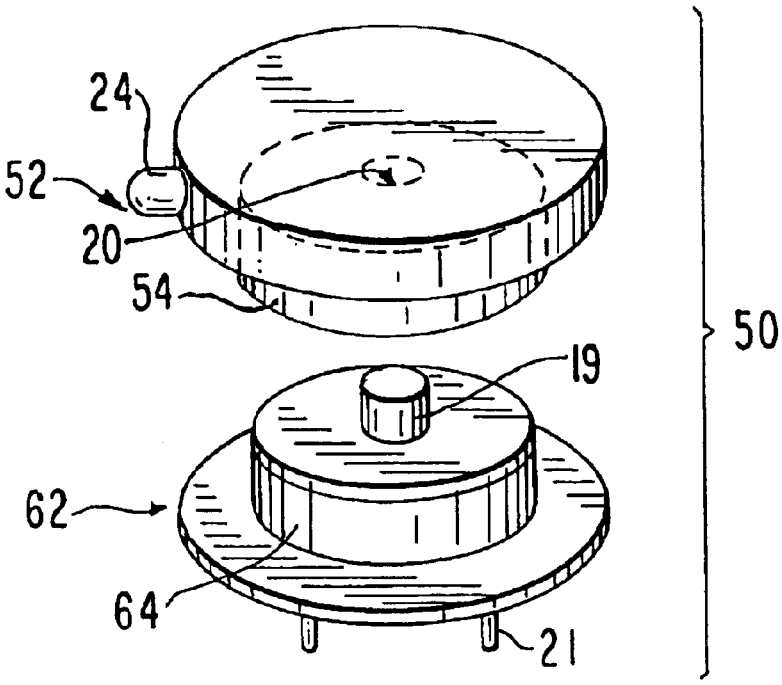
FIG. 3A is a side elevation view, partly in cross-section of another embodiment of the invention utilized with a snap fastener in the open, illuminating position.
Figure 3B:
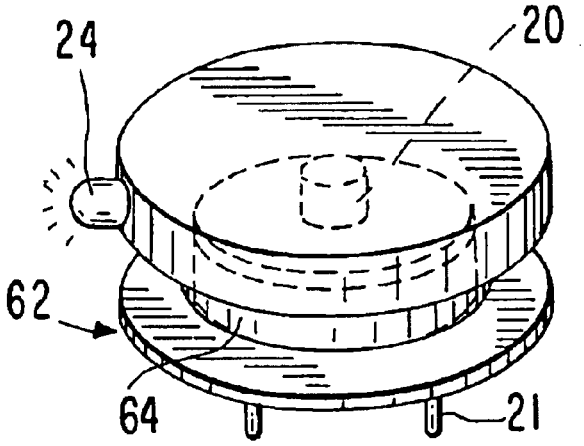
FIG. 3B is a view of the embodiment of FIG. 3A in the closed, off position.

With reference to FIGS. 3A and 3B there is illustrated a snap fastener assembly 50 comprising a first member 52 of generally circular configuration having a raised rim 54 and central opening 20 below which is securely positioned switch 26 of lighting device 10.

A movable portion 27 of switch 26 is accessible through opening 56 and when subjected to a force F, opens the internal contacts of switch 26 to interrupt the electrical circuit between associated LED 24 and battery 28.

The second member 62 of snap fastener assembly 50 has a circumferential depending wall 64 dimensioned to releasably engage rim 54 of first member 52 and a depending central post 19 positioned to pass through opening 20 and operably depress exposed portion 27 of switch 26.

As shown in FIG. 3B, when the snap members 52 and 62 are engaged to close the container, post 19 opens the switch contacts 28 interrupting the circuit to the battery and thereby turning off the LED 24.

Snap fasteners of configurations other than generally circular can be utilized in the practice of the invention. In the embodiment illustrated in FIGS. 3 and 4 the post 66 is centrally positioned; however, it is to be understood that the post and switch can be displaced to a position adjacent the circumference of the snap elements and functioning in cooperation with the fastener elements in the manner described above.

In an alternative embodiment, a bayonet-type fastener is provided which is twisted to lock complementary members of the fastener in place, and to position the complementary members in a correct position to activate or deactivate the light. Threading or other mating and complementary surfaces can be used to align the portions of the light to control any electrical contact to turn on or turn off the light.

Figure 4A:
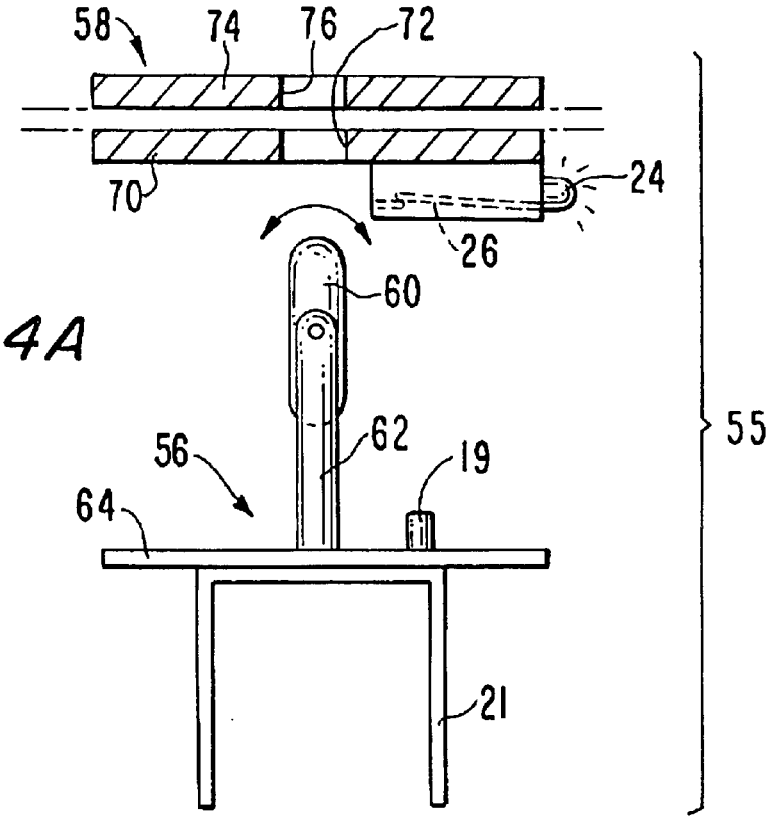
FIG. 4A is a side elevation view, partly in cross-section, of still another embodiment of the invention with a magnetically activated switch, with the fastener in the open position.
Figure 4B:
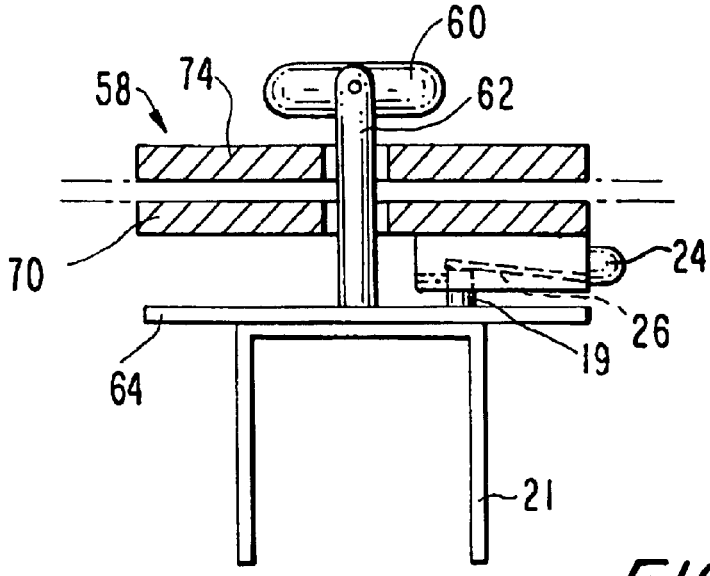
FIG. 4B is a view of the embodiment of FIG. 4A with the fastener in the closed position.

With reference to FIGS. 4A and 4B, there is schematically illustrated yet another type of fastener assembly 55, where a pivoting locking bar or arm 60 is mounted on supporting rod 62 that is integrally joined to mounting plate 64. Prongs 21 are attached to the opposite side of plate 64 for attaching the assembly of first fastener member 61 to one wall of a handbag or other container (not shown).

The second member 58 includes an inner plate 70 having an orifice 72 and an outer plate 74 with orifice 76 for receiving the locking arm 60 and rod 62 when the container is to be closed.

Figure 5A:
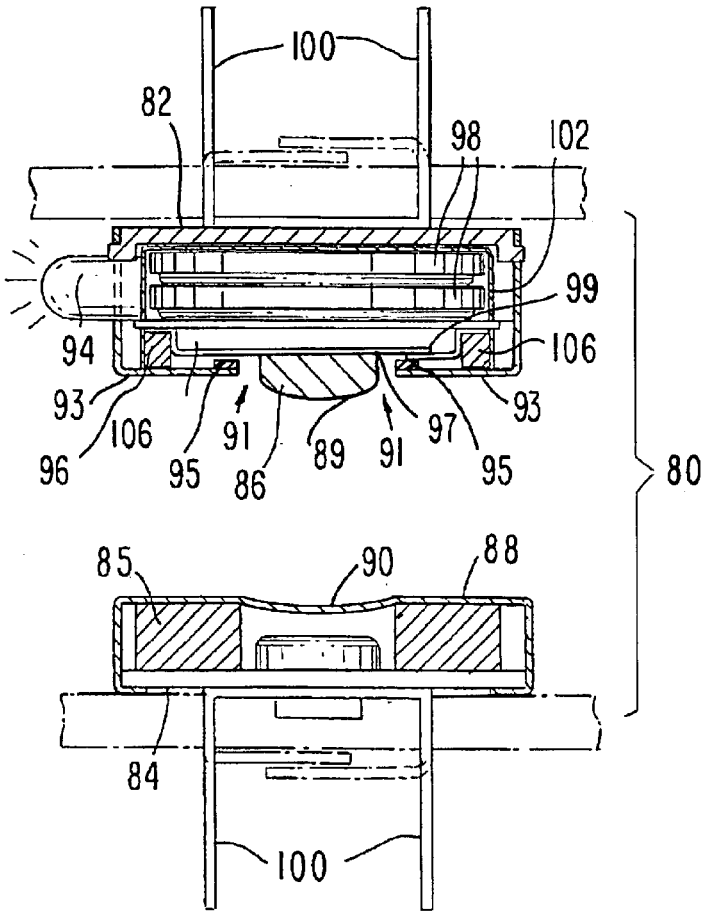
FIG. 5A is a side elevation view, partly in cross-section, of a further embodiment of the invention with a magnetically activated switch, with the fastener in the open position.
Figure 5B:
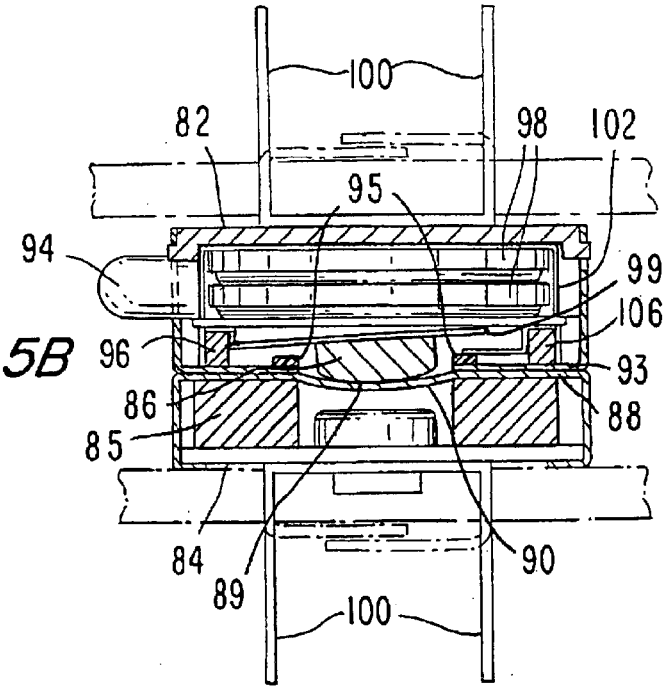
FIG. 5B is a view of the embodiment of FIG. 5A with the fastener in the closed position.

In a further alternative embodiment, shown in FIGS. 5A and 5B, the combination fastener and lighting device assembly 80 includes a pair of complimentary fastener members 82, 84 of the fastener 80 for removably securing portions of a carrying case in a closed position when complementary mating surfaces 86, 88, respectively, of the complementary fastener members 82, 84 are placed in contact with each other. FIG. 5A shows the fastener 80 in a separated or open position and FIG. 5B shows the fastener 80 in the closed position.

The fastener members 82, 84 are secured to the portions of the accessory, such as a flap and side wall of a handbag (not shown), using conventional mounting prongs 100. The lighting device includes a circuit 102 containing at least one light-emitting diode (LED) 94, a switch 96, and at least one battery 98. The switch 96 comprises movable arm element 97 and contacts 99 which can be actuated by pressure to close the contacts 99, or alternatively the contacts 99 can be magnetically actuated by changes in magnetic field strength, such as proximity to the magnet 85. The lighting device can include the features described in U.S. Pat. No. 6,120,162, and co-pending U.S. application Ser. No. 09/750,879, the disclosures of which are incorporated herein by reference.

The switch 96 can be a spring rocker switch which provides biasing force to keep the switch contacts 99 closed until pressure by mating the members 82, 84 or a magnetic force by proximity to the magnet 85 when the members 82, 84 are mated, overcomes the biasing force to open the contacts 99.

The lighting device is incorporated in first member 82 of the pair of complementary fastener member 80. Mating surface 88 is provided with an access aperture 90. Mating surface 86 includes a projecting portion 89 extending through an opening 91 in the housing 93 of the first member 82, with the projecting portion 89 being receivable in aperture 90, and so to close the contacts 97 when the fastener members 82 and 84 are brought into mating relation. An insulating washer 95 surrounds the opening 91 and electrically isolates the mating surface 86 and its projecting portion 89 from electrical contact with the housing 93, to prevent inadvertent activation of the circuit 102.

The lighting device is deactivated so that the LED 94 does not generate light when the complementary surfaces 86, 88 are placed in contact with each other to thereby open the contacts 99 of the switch 96. The lighting device is activated to power the LED 94 to illuminate an interior of a case when the complementary surfaces 86, 88 are separated from each other and the switch contacts 99 close and complete the circuit with the battery power source 98.

In one preferred embodiment, any physical pressure on the surface 86 actuates the switch 96 to deactivate the LED 94. In a further preferred embodiment, switch element 97 includes a microprocessor 106 in the circuit 102 of the lighting device so that switch 96 will function as a push button 'on-off' switch.

As will be understood by those of ordinary skill in the art, other types of two-member fasteners that are conventionally employed as closures for handbags, make-up pouches, briefcases and the like can readily be adapted to receive a compact lighting device in one of the members, which is also provided with a switch that is in the on position when the members are separated, while the second member is provided with switch-deactivating means that function to turn off the light source when the fastener members are operably engaged.

I claim:

1. A combination fastener and lighting device for a portable carrying case comprising:

a pair of complementary fastener members for releasably securing portions of a carrying case in a closed position when mating surfaces of the complementary members are placed proximate to each other;

a lighting device including a light emitting diode (LED), a power source and a switch operatively connected to the power source and LED, said lighting device being incorporated in a first of the pair of fastener members, the switch being positioned in said first member to be operatively moved from an on position to an off position by a portion of the second fastener member when the mating surfaces of the first and second members are brought proximate to each other, whereby the lighting device is deactivated when the mating surfaces are placed in contact with each other and the lighting device is activated to illuminate an interior portion of the carrying case when the mating surfaces are separated from each other;

wherein the first fastener member is formed with an access aperture adjacent the switch and the second fastener member includes a projecting portion corresponding to the access aperture when the fastener members are in a mating relation, whereby the projecting portion of the second member makes operable contact with the switch surface below the aperture to move the switch from an on position to an on off position;

wherein the pair of fastener members are configured to mate in mechanical engagement;

wherein the fastener members are configured to engage in a snap fitting relation; and wherein the lighting device is removable from said first fastener member, whereby the light device can be utilized independently of the carrying case.

2. The device of claim 1, wherein one of the pair of fastener members includes a magnet and the other member includes a ferro-magnetic material, whereby the mated members are releasably joined by magnetic field forces.

3. The combination fastener and lighting device of claim 1, wherein one of the fastener members includes a magnet and the other member includes a ferro-magnetic material; and the switch of the lighting device includes a reed switch which is operatively activated by the magnetic force to power the LED when the complementary surfaces are separated from each other.

4. The device of claim 3, wherein the switch comprises a movable portion that is biased to move to the off position when the fastener members are separated from each other.

5. The device of claim 1, wherein a second of the pair of fastener devices includes a projecting portion that engages the switch to move it to an open position and deactivate the LED when the complementary surfaces are brought proximate to each other.

6. The combination device of claim 1, wherein the light device further comprises a programmed microprocessor controller operatively connected to the switch and LED that is programmed to deactivate the LED when the mating surfaces of the fastener have been separated for a predetermined period of time.

7. The combination device of claim 6, wherein the controller is responsive to a change of position of the switch when the mating surfaces of the fastener are separated to change the condition of the LED between activated and deactivated conditions.

8. The combination device of claim 7, wherein the fastener member containing the lighting device includes a projecting portion that is moveable between a first position when the LED is activated and a second position when the LED is deactivated.

9. The combination device of claim 7, wherein the fastener member that includes the lighting device has a moveable projecting activator, a distal end of which activator is in contact with a portion of the switch and a proximal external end of the activator being manually accessible, whereby pressure manually applied to the external end of the activator produces a change in the condition of the LED between activated and deactivated.

10. The combination device of claim 9, wherein the lighting device is removable from the fastener member, whereby the lighting device can be utilized independently of the carrying case.

11. A combination fastener and lighting device for a portable carrying case comprising:

a pair of complementary fastener members for releasably securing portions of a carrying case in a closed position when mating surfaces of the complementary members are placed proximate to each other;

a lighting device including a light emitting diode (LED, a power source and a switch operatively connected to the power source and LED, said lighting device being incorporated in a first of the pair of fastener members, the switch being positioned in said first member to be operatively moved from an on position to an off position by a portion of the second fastener member when the mating surfaces of the first and second members are brought proximate to each other;

whereby the lighting device is deactivated when the mating surfaces are placed in contact with each other and the lighting device is activated to illuminate an interior portion of the carrying case when the mating surfaces are separated from each other;

wherein the light device further comprises a programmed microprocessor controller operatively connected to the switch and LED that is programmed to deactivate the LED when the mating surfaces of the fastener have been separated for a predetermined period of time;

wherein the controller is responsive to a change of position of the switch when the mating surfaces of the fasteners are separated to change the condition of the LED between activated and deactivated conditions; and wherein the fastener member that includes the lighting device has a moveable projecting activator a distal end of which activator is in contact with a portion of the switch and a proximal external end of the activator being manually accessible, whereby pressure manually applied to the external end of the activator produces a change in the condition of the LED between activated and deactivated.

12. The combination device of claim 11, wherein the lighting device is removable from the fastener member, whereby the lighting device can be utilized independently of the carrying case.

* * * * *